US008056482B2

(12) United States Patent
Rodet

(10) Patent No.: US 8,056,482 B2
(45) Date of Patent: Nov. 15, 2011

(54) ARTICULATED BOGIE FOR A RAILWAY VEHICLE

(75) Inventor: Alain Rodet, Chalon sur Saone (FR)

(73) Assignee: Alstom Transport SA, Levallois-Perret (FR)

( * ) Notice: Subject to any disclaimer, the term of this patent is extended or adjusted under 35 U.S.C. 154(b) by 0 days.

(21) Appl. No.: 12/802,369

(22) Filed: Jun. 4, 2010

(65) Prior Publication Data

US 2010/0307371 A1 Dec. 9, 2010

(30) Foreign Application Priority Data

Jun. 5, 2009 (FR) ..... 09 53726

(51) Int. Cl.
*B61C 1/00* (2006.01)

(52) U.S. Cl. ..... 105/133; 105/199.1; 105/206.1

(58) Field of Classification Search ..... 105/167, 105/182.1, 133, 138, 218.1, 218.2, 219, 223, 105/224.05, 174, 175.1
See application file for complete search history.

(56) References Cited

U.S. PATENT DOCUMENTS

| | | | | |
|---|---|---|---|---|
| 2,892,420 | A * | 6/1959 | Cooper | 105/194 |
| 3,661,097 | A * | 5/1972 | Jackson | 105/199.3 |
| 4,362,109 | A * | 12/1982 | Panagin | 105/182.1 |
| 4,628,824 | A * | 12/1986 | Goding et al. | 105/168 |
| 4,787,318 | A * | 11/1988 | Vogel | 105/136 |
| 5,086,706 | A * | 2/1992 | Boivin | 105/168 |
| 5,181,473 | A * | 1/1993 | Petit et al. | 105/133 |
| 5,205,220 | A * | 4/1993 | Wallace | 105/167 |
| 5,235,918 | A * | 8/1993 | Durand et al. | 105/222 |
| 6,082,766 | A * | 7/2000 | Rodet et al. | 280/781 |
| 6,637,344 | B2 * | 10/2003 | Martin | 105/157.1 |
| 2010/0083866 | A1 * | 4/2010 | Rodet et al. | 105/34.1 |
| 2010/0132585 | A1 * | 6/2010 | Rodet et al. | 105/133 |
| 2010/0186620 | A1 * | 7/2010 | Rodet et al. | 105/182.1 |
| 2010/0307370 | A1 * | 12/2010 | Rodet | 105/96.1 |
| 2010/0307371 | A1 * | 12/2010 | Rodet | 105/133 |

FOREIGN PATENT DOCUMENTS

| | | | |
|---|---|---|---|
| CH | 255 097 | A | 12/1942 |
| EP | 0 277 929 | A1 | 8/1988 |
| EP | 0 409 128 | | 1/1991 |
| GB | 555 188 | | 8/1943 |
| GB | 2 033 857 | A | 5/1980 |

* cited by examiner

*Primary Examiner* — Joe Morano, IV
*Assistant Examiner* — Jason C Smith
(74) *Attorney, Agent, or Firm* — Davidson, Davidson & Kappel, LLC

(57) ABSTRACT

A bogie includes two pairs of wheels (2), the wheels (2) of one pair being connected to one another by a shaft to form an axle (4), the axles (4) being connected to one another by two half-chasses (8) each having two side members (10) connected to one another by a cross-member (12). The side members (10) rest on one of said axles (4), the cross-members (10) of the half-chassis (8) being articulated by an articulation device (18) so as to permit rotation of one half-chassis (8) relative to the other about a substantially longitudinal axis (A). Each side member (10) of a half-chassis (8) is connected to a side member (10) of the other half-chassis (8) by a connector (20) mounted in an articulated manner about substantially transverse axes on the side members (10), the connector (20) extending at least partially in a horizontal plane offset in terms of height relative to the horizontal plane passing through the articulation device (18).

12 Claims, 3 Drawing Sheets

ARTICULATED BOGIE FOR A RAILWAY VEHICLE

This claims the benefit of French Patent Application FR 09 53726, filed Jun. 5, 2009 and hereby incorporated by reference herein.

The present invention relates to a bogie for a railway vehicle, of the type comprising two pairs of wheels, the wheels of one pair being connected to one another by a shaft to form an axle, said axles being connected to one another by a chassis comprising two half-chassis, each half-chassis having two side members connected to one another by a cross-member, said side members resting on one of said axles, the cross-members of the half-chassis being articulated relative to one another by an articulation means so as to permit rotation of one half-chassis relative to the other about a substantially longitudinal axis.

The invention relates also to a railway vehicle comprising such a bogie.

BACKGROUND

The bogies of railway vehicles must be able to travel over distortions, that is to say be able to exhibit points of support on the ground which are not in the same plane, because the tracks can have defects, called "distortions".

When the bogie is of the "rigid chassis" type, it is mainly the flexibility of the suspension between the axles and the bogie chassis which allows wheel load transfers to be limited when the vehicle travels over distortions in the track. When the bogie is of the "articulated chassis" type, such as, for example, the bogie described in document EP 0 409 128, it is the articulation of two half-chassis about a transverse axis which allows the wheel load transfers induced by distortions of the track to be limited.

However, a rigid chassis requires the presence of a primary suspension, that is to say of a suspension arranged between the axles and the bogie chassis, for absorbing distortions, which suspension is bulky and heavy. It is possible for an articulated chassis not to have primary suspensions, because deformations in the event of distortions are absorbed by the articulation of the chassis. This solution accordingly enables a weight saving to be made and is of greater interest economically.

The chassis of the bogie is either of the "exterior" type, when the side members are arranged outside the wheels, generally resting on axle boxes arranged outside the wheels, or, on the other hand, of the "interior" type when the side members are arranged inside the wheels, that is to say between the wheels, on axle boxes which are likewise arranged inside the wheels. An interior chassis enables the mass of the bogie to be lowered and its manufacturing costs to be reduced. Such a chassis also allows the brake callipers to be accommodated outside the chassis, which improves the accessibility of the callipers should they have to be removed.

The exterior chassis is more bulky and adds a considerable mass to the railway vehicle. However, it allows a larger and more powerful motor to be accommodated between the wheels because the axle boxes located outside the wheels free space between the wheels.

SUMMARY OF THE INVENTION

One of the objects of the invention is to remedy those disadvantages by proposing a compact bogie of reduced mass.

It is an object of the present invention to provide a bogie of the above-mentioned type, in which each side member of a half-chassis is connected to a side member of the other half-chassis by a connector mounted in an articulated manner about substantially transverse axes on said side members, said rod extending at least partially in a horizontal plane offset in terms of height relative to the horizontal plane passing through the articulation means.

According to other features of the bogie:

a motor is fixed to the cross-member of one half-chassis, said motor extending between the wheels of the axle on which said half-chassis rests and driving said axle in rotation;

the side members of one half-chassis rest on one of the axles by way of at least one primary suspension permitting relative vertical displacement of the axle relative to the half-chassis resting on said axle;

the side members of each half-chassis rest on axle boxes of each axle, said boxes being arranged between the wheels of said axle;

the side members of each half-chassis rest on axle boxes of each axle, said boxes being arranged outside the wheels of said axle;

the connectors have a stirrup shape and accommodate secondary suspensions, said secondary suspensions permitting relative vertical displacement of the bogie relative to the railway vehicle on which said bogie is mounted;

the connectors have a bar shape, the half-chassis comprising plates arranged to project in the transverse direction relative to the rods, said plates supporting secondary suspensions, said secondary suspensions permitting relative vertical displacement of the bogie relative to the railway vehicle on which said bogie is mounted;

the difference in height between the horizontal plane in which the connectors extend at least partially and the horizontal plane passing through the articulated joint is at least equal to ⅙ of the wheel base of the bogie;

the spacing in the transverse direction between the two connectors is approximately equal to ⅓ of the wheel base of the bogie.

The invention relates also to a railway vehicle comprising at least one bogie as described above.

BRIEF DESCRIPTION OF THE DRAWINGS

Other aspects and advantages of the invention will become apparent from reading the following description, which is given by way of example and with reference to the accompanying drawings, in which.

DETAILED DESCRIPTION

In the description, the terms "vertical" and "horizontal" are defined relative to a bogie mounted in a railway vehicle. Accordingly, a horizontal plane is substantially parallel to the plane in which the axles extend, and the vertical plane is substantially parallel to the plane in which the wheels extend. The term "longitudinal" is defined relative to the direction in which a railway vehicle extends in a horizontal plane, and the term "transverse" is defined in a direction substantially perpendicular to the longitudinal direction in a horizontal plane.

Figure 1:
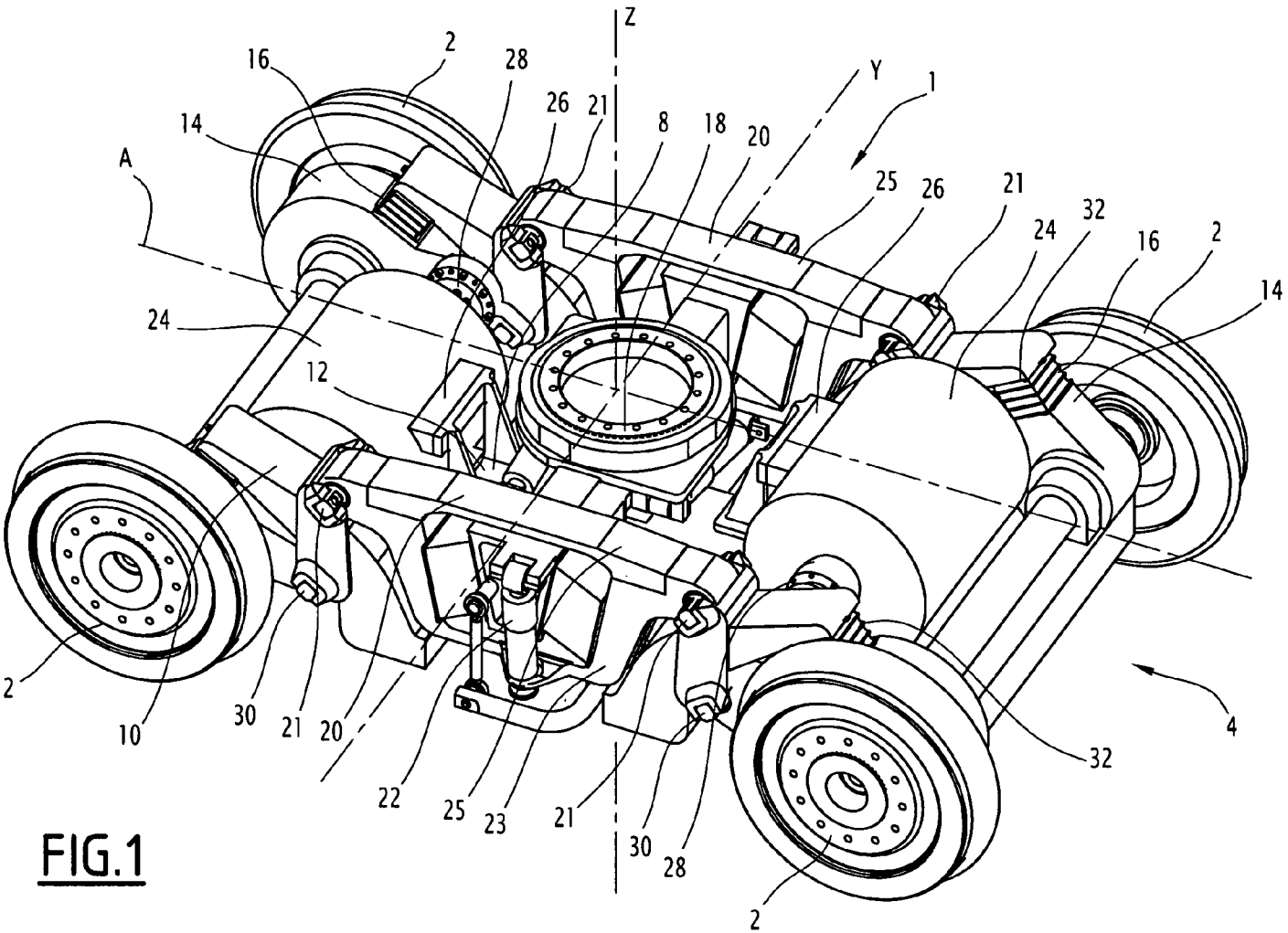
FIG. 1 is a perspective representation of a railway vehicle bogie according to a first embodiment of the invention.

With reference to FIG. 1, a bogie 1 of a railway vehicle (not shown), for example a subway vehicle, is described.

The bogie 1 comprises two pairs of wheels 2, the wheels 2 of each pair being connected to one another by a shaft to form an axle 4. The axles 4 are connected to one another by a chassis 6, called an interior chassis, which comprises two half-chassis 8 each integral with an axle 4. Interior chassis is understood as meaning that the chassis 6 extends substantially between the wheels 2 in the transverse direction without "projecting" beyond them.

Figure 2:
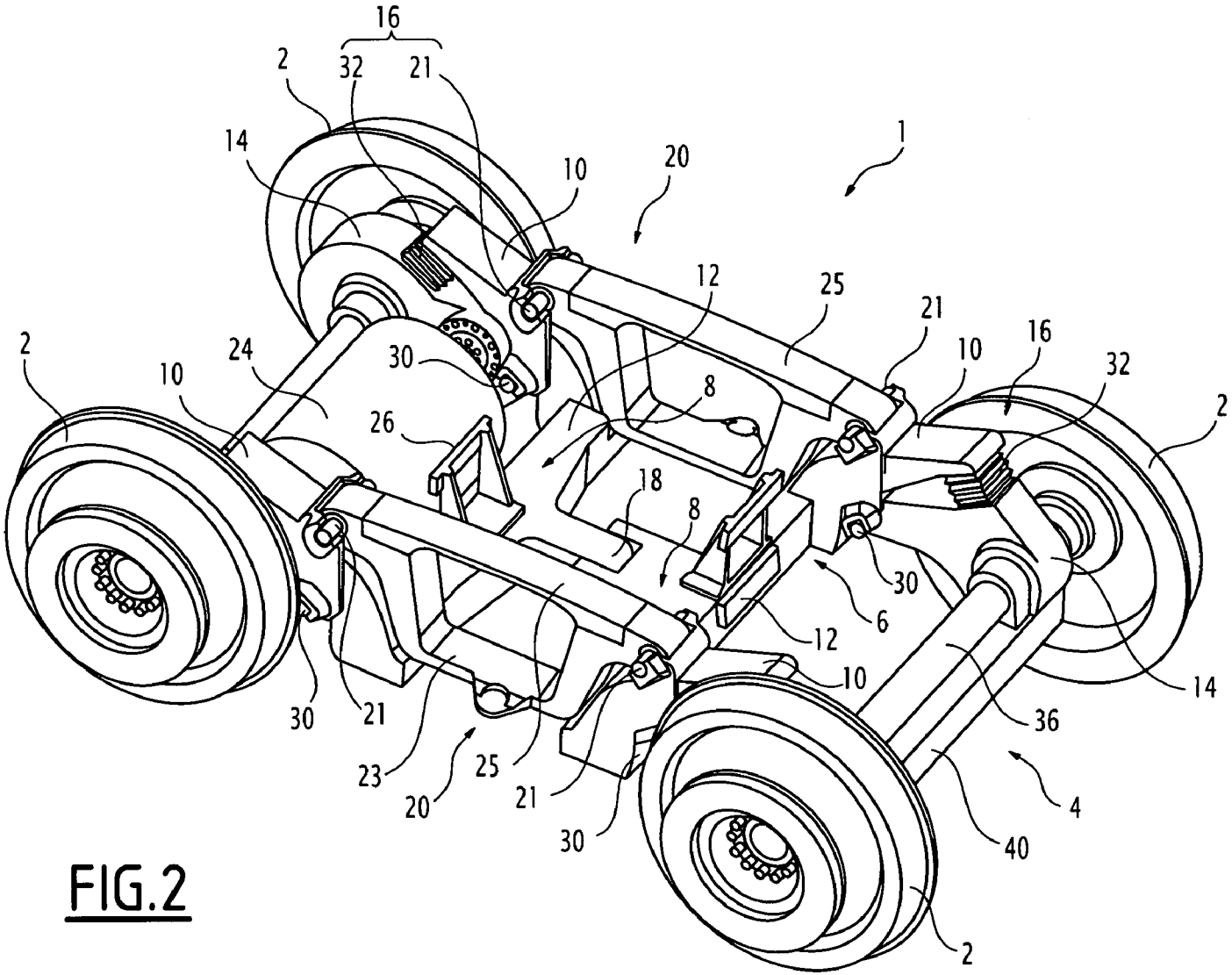
FIG. 2 is a perspective representation of a bogie according to another embodiment of the invention.

Each half-chassis 8 comprises two side members 10 which extend substantially longitudinally and are connected to one another by a cross-member 12, which extends substantially transversely. Each side member 10 rests on the axle boxes 14 of an axle 4, said axle boxes 14 being arranged substantially against the wheels 2 of the axle 4, between said wheels 2. The cross-member 12 extends at a height lower than that of the side members 10, as is shown in FIG. 2, which allows a larger space to be freed between the two axles 4 of the bogie 1.

The cross-members 12 of the half-chassis 8 are articulated with one another by an articulated joint 18, or ball-and-socket joint, so as to permit rotation of one half-chassis 8 relative to the other about a substantially longitudinal axis A, said rotation permitting adaptation to the distortions to which the bogie is subjected. The articulated joint can be of the dry ball-and-socket type or of the spherical or cylindrical articulated rubber joint type. The ball-and-socket joint blocks the three translational movements along the substantially longitudinal axis A, transverse axis Y and vertical axis Z of the two half-chassis relative to one another.

The side members 10 of the opposing half-chassis 8 are connected to one another by two rods 20 so as to block the relative rotations of the two half-chassis about the substantially vertical axis Z and the substantially transverse axis Y passing through the articulated joint 18. The two half-chassis are then maintained one on the other so that the axles remain parallel and the bogie 1 does not fold in on itself under the effect of the vertical load. On the other hand, the two half-chassis are able to rotate relative to one another about the substantially longitudinal axis A in order to accept distortions of the track.

To that end, the points of connection of the two connectors 20 to the side members 10 are located in a horizontal plane offset relative to the horizontal plane passing through the articulated joint 18. According to the embodiment shown in the figures, the points of connection of the two connectors 20 are located in a horizontal plane which extends above the horizontal plane passing through the articulated joint 18. According to another embodiment, the points of connection of the two connectors extend in a plane which extends below the horizontal plane passing through the articulated joint 18. The connectors are also spaced from one another in the transverse direction. The difference in height H between the horizontal plane of the points of connection of the connectors 20 and the horizontal plane passing through the articulated joint 18 must be sufficient to limit the stresses to which the connectors 20 and the articulated joint 18 are subject under the effect of the vertical load. The distance H must approximately be at least equal to ⅙ of the wheel base of the bogie. The spacing L between the two connectors must be sufficient to limit the stresses to which the rods and the articulated joint are subject under the effect of the stresses of taking curves, for example. The spacing must approximately be equal to ⅓ of the wheel base of the bogie for a bogie travelling on a track of normal gauge, that is to say having a track gauge of 1435 mm.

The connectors 20 are connected to the side members 10 by articulated joints 21, principally about substantially transverse axes, in order to allow the desired principal freedom of the two half-chassis 8 relative to one another for travelling over distortions of the track. The articulated joints 21 of the rods can be of the dry ball-and-socket type or of the spherical or cylindrical articulated rubber joint type.

In a first embodiment of the invention shown in FIG. 1, the connectors 20 have, for example, a stirrup shape permitting the accommodation of a secondary suspension 22 in each of said connectors 20. The secondary suspension is then said to be "integrated" into each connector 20, as shown in FIG. 1. In this example, each connector 20 is composed of two elements, a first, stirrup-shaped element 23 connected to the side members 10 by the articulated joints 21, and a second element 25 which is arranged on the two upper parts of the stirrup 23 and connects said parts together. The purpose of the second element 25 is to avoid spreading of the stirrup under the effect of the longitudinal stresses produced by the secondary suspension 22. The secondary suspensions 22 permit inter alia a relative vertical displacement of the bogie 1 relative to the railway vehicle on which said bogie 1 is mounted. The secondary suspension 22 can be of the pneumatic type or of the elastomer suspension type.

Figure 3:
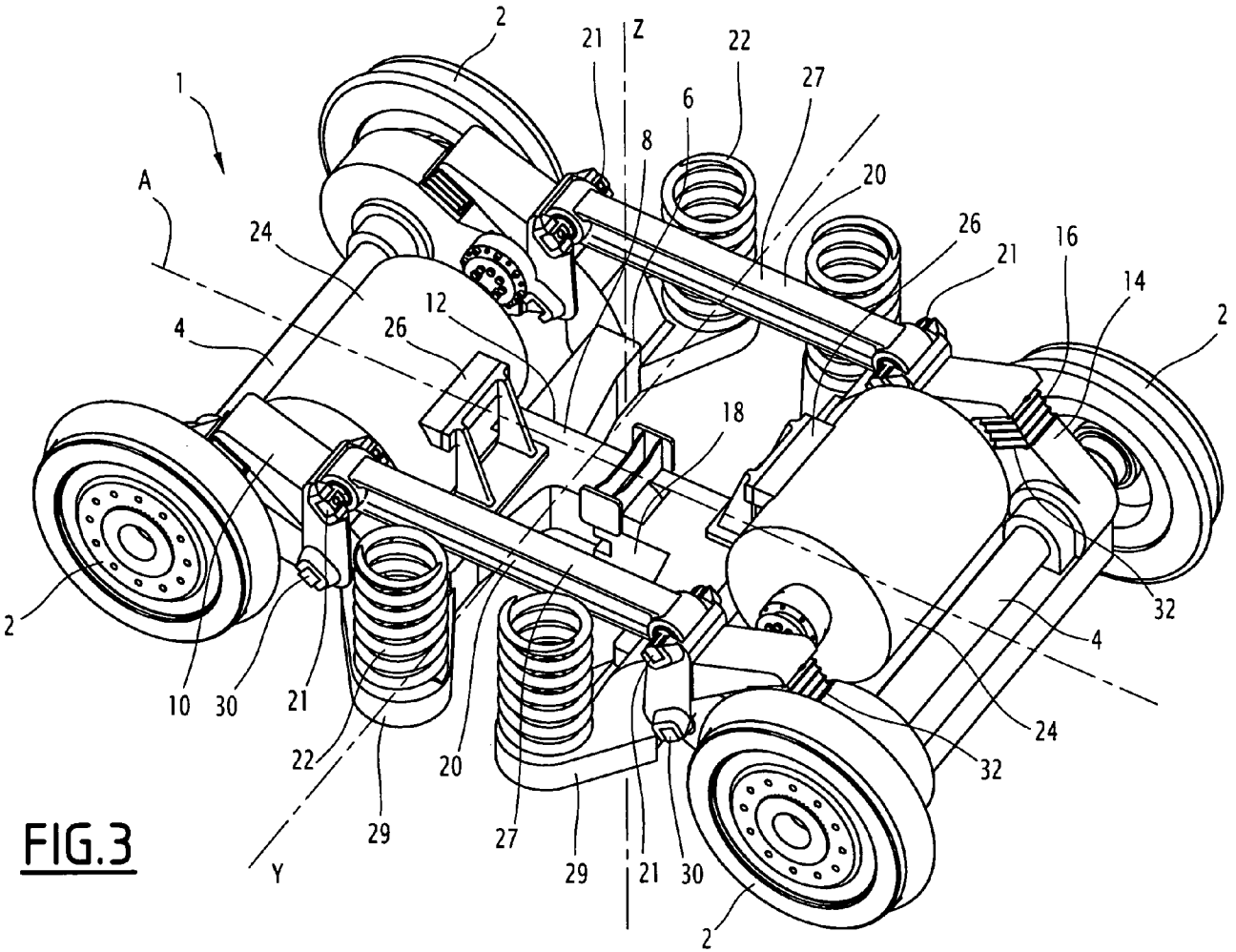
FIG. 3 is a perspective representation of a bogie according to another embodiment of the invention.

In another embodiment of the invention shown in FIG. 3, the connectors 20 are in the form of bars 27 which connect the side members 10 of the half-chassis 8 together and are connected to the side members by the articulated joints 21. The half-chassis 8 comprise plates 29 which are arranged to project in the transverse direction relative to the connectors 20, as is shown in FIG. 3. That is to say, the plates 29 are arranged beyond the space separating the connectors 20. The plates 29 extend, for example, substantially as far as the wheels 2. The plates 29 receive the secondary suspensions 22. Although the bogie according to this embodiment is more bulky than that of the first embodiment, it is simpler and less expensive to produce.

The bogie described above can be a power bogie, that is to say at least one of the axles 4 is driven in rotation by a motor 24. According to the embodiment shown in FIG. 2, only one axle is driven by a motor 24, while according to the embodiment shown in FIG. 1 or 3, the two axles 4 of the bogie 1 are each driven by a motor 24.

The motor 24 is, for example, fixed relative to the chassis 6 of the bogie 1, fixed, for example, to a cross-member 12 of a half-chassis 8 by a fixing stirrup 26, and extends close to the axle 4 that it drives, substantially between the two wheels 2.

Other motor assemblies, with a hollow shaft or "Canon box", are obviously possible.

In the case of a powerful and bulky motor, the axle boxes 14 will be arranged outside the wheels, and the half-chassis will be spaced in the transverse direction to rest on the axle boxes.

In the example of FIG. 1, a primary suspension 16 which absorbs only vertical displacements is interposed between each side member 10 and the axle box 14 on which said side member 10 is resting. The primary suspension 16 is here formed by an assembly composed of two articulated joints 30 of the cylindrical rubber type, for example, arranged between the cross-member 12 and each axle box 14, which delimit a transverse axis of rotation of the axle 4 relative to the bogie half-chassis 8, and two rubber blocks 32, for example, located between the side member 10 of the half-chassis 8 and each axle box 14. The primary suspension 16 permits relative vertical displacement of the axle 4 relative to the half-chassis 8, that is to say the axle 4 is suspended relative to the chassis in a substantially vertical direction. The primary suspension 16 is particularly compact.

Providing a chassis comprising simple primary suspensions that absorb only vertical displacements and an articulated joint between the two half-chassis 8 that absorbs distortions makes it possible to do without a complex suspension that absorbs all those displacements of the bogie. A space saving is thus made, allowing a gear motor to be accommodated more easily between the wheels of the bogie. The primary suspension especially has the advantage of permitting a reduction in the suspended masses, especially in the case of a motorized bogie.

The bogie can also be unpowered, that is to say none of its axles is driven in rotation. In that case, it is possible for the chassis not to have a primary suspension, travel over distortions being absorbed by the articulated joint 18.

There is accordingly obtained an unpowered or power bogie 1 having an interior or exterior articulated chassis 8, with or without primary suspension, which is compact and of low mass.

What is claimed is:

1. A bogie for a railway vehicle, comprising:

two pairs of wheels, the wheels of one pair being connected to one another by a shaft to form a respective axle, the axles being connected to one another by a chassis comprising two half-chasses, each half-chassis having two side members connected to one another by a cross-member, the side members of a respective half chassis resting on a respective one of the axles, the cross-members of the half-chasses being articulated relative to one another by an articulation device so as to permit rotation of one half-chassis relative to the other about a substantially longitudinal axis, each side member of a respective half-chassis being connected to an other side member of the other half-chassis by a connector mounted in an articulated manner by articulated joints about substantially transverse axes on the side members, the connector and articulated joints extending at least partially in a horizontal plane offset in terms of height relative to the horizontal plane passing through the articulation device.

2. The bogie as recited in claim 1 further comprising a motor fixed to the cross-member of one of the half-chasses, the motor extending between the wheels of the axle on which the one half-chassis rests and driving the axle in rotation.

3. The bogie as recited in claim 1 wherein the side members of one of the half-chasses rest on one of the axles by way of at least one primary suspension permitting relative vertical displacement of the axle relative to the half-chassis resting on the axle.

4. The bogie as recited in claim 1 wherein the side members of each half-chassis rest on axle boxes of a respective axle, the axle boxes being arranged between the wheels of the respective axle.

5. The bogie as recited in claim 1 wherein the side members of each half-chassis rest on axle boxes of a respective axle, the axle boxes being arranged outside the wheels of the respective axle.

6. The bogie as recited in claim 1 wherein a difference in height between the horizontal plane in which the connectors extend at least partially and the horizontal plane passing through the articulation device is at least equal to ⅙ of the wheel base of the bogie.

7. The bogie as recited in claim 1 wherein a spacing in the transverse direction between the two connectors is approximately equal to ⅓ of the wheel base of the bogie.

8. A railway vehicle comprising at least one bogie as recited in claim 1.

9. The bogie as recited in claim 1 wherein the articulation device is a ball and socket joint.

10. The bogie as recited in claim 1 wherein the articulation device is a spherical or cylindrical articulated rubber joint type.

11. A bogie for a railway vehicle, comprising:

two pairs of wheels, the wheels of one pair being connected to one another by a shaft to form a respective axle, the axles being connected to one another by a chassis comprising two half-chasses, each half-chassis having two side members connected to one another by a cross-member, the side members of a respective half chassis resting on a respective one of the axles, the cross-members of the half-chasses being articulated relative to one another by an articulation device so as to permit rotation of one half-chassis relative to the other about a substantially longitudinal axis, each side member of a respective half-chassis being connected to an other side member of the other half-chassis by a connector mounted in an articulated manner about substantially transverse axes on the side members, the connector extending at least partially in a horizontal plane offset in terms of height relative to the horizontal plane passing through the articulation device, wherein the connectors have a stirrup shape and accommodate secondary suspensions, the secondary suspensions permitting relative vertical displacement of the bogie relative to the railway vehicle on which the bogie is mounted.

12. A bogie for a railway vehicle, comprising:

two pairs of wheels, the wheels of one pair being connected to one another by a shaft to form a respective axle, the axles being connected to one another by a chassis comprising two half-chasses, each half-chassis having two side members connected to one another by a cross-member, the side members of a respective half chassis resting on a respective one of the axles, the cross-members of the half-chasses being articulated relative to one another by an articulation device so as to permit rotation of one half-chassis relative to the other about a substantially longitudinal axis, each side member of a respective half-chassis being connected to an other side member of the other half-chassis by a connector mounted in an articulated manner about substantially transverse axes on the side members, the connector extending at least partially in a horizontal plane offset in terms of height relative to the horizontal plane passing through the articulation device, wherein the connectors have a bar shape and the half-chassis includes plates arranged to project in the transverse direction relative to the connectors, the plates supporting secondary suspensions, the secondary suspensions permitting relative vertical displacement of the bogie relative to the railway vehicle on which said bogie is mounted.

* * * * *